US008607771B1

(12) United States Patent
Marsh

(10) Patent No.: US 8,607,771 B1
(45) Date of Patent: Dec. 17, 2013

(54) AUTOMATICALLY-REPEATING, RAPID-FIRING RUBBER BAND GUN WITH AN AMMUNITION-POWERED OPERATING SYSTEM

(76) Inventor: Julian Lyndon Marsh, Anchorage, AK (US)

( * ) Notice: Subject to any disclaimer, the term of this patent is extended or adjusted under 35 U.S.C. 154(b) by 273 days.

(21) Appl. No.: 13/317,116

(22) Filed: Oct. 11, 2011

Related U.S. Application Data

(60) Provisional application No. 61/455,647, filed on Oct. 25, 2010.

(51) Int. Cl.
*F41B 7/02* (2006.01)

(52) U.S. Cl.
USPC ..... 124/19

(58) Field of Classification Search
USPC ..... 124/18, 19
See application file for complete search history.

(56) References Cited

U.S. PATENT DOCUMENTS

| | | | | | |
|---|---|---|---|---|---|
| 3,515,387 | A * | 6/1970 | House | 273/362 |
| 3,693,609 | A * | 9/1972 | Vodinh | 124/19 |
| 3,757,760 | A * | 9/1973 | Darnell | 124/19 |
| 4,800,864 | A * | 1/1989 | Small | 124/19 |
| 5,222,472 | A * | 6/1993 | Landingham | 124/19 |
| 5,460,150 | A * | 10/1995 | Joppe | 124/19 |

* cited by examiner

*Primary Examiner* — John Ricci

(57) ABSTRACT

An automatically-repeating, rapid-firing rubber band gun with an ammunition powered operating system. The gun includes a mechanism for retaining, releasing and projecting a plurality of stretched rubber bands, with the release of the rubber bands occurring in such a manner as to allow the harnessing of a portion of the elastic potential energy present in the rubber bands to perform work upon the mechanism. Work performed upon the mechanism results in the mechanism moving relative to a static structure within the gun, and this relative movement affects a temporal sequencing of the release of the rubber bands. A trigger system provides for control of rubber band discharge by way of alternately inhibiting or allowing rubber band release. A structural frame supports the operating system and provides for the gun to be manually operated.

20 Claims, 6 Drawing Sheets

AUTOMATICALLY-REPEATING, RAPID-FIRING RUBBER BAND GUN WITH AN AMMUNITION-POWERED OPERATING SYSTEM

CROSS REFERENCE TO RELATED APPLICATIONS

This application is based on provisional application Ser. No. 61/455,647, filed on Oct. 25, 2010.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of toy rubber band guns and more specifically to an automatically-repeating, rapid-firing rubber band gun with an ammunition-powered operating system.

The history of rubber band guns is documented at least as far back as the early twentieth century. The first rubber band guns may have followed from the recognition of the capacity of rubber bands to function both as a projectile object, as well as a repository of elastic potential energy which could be easily harnessed so as to affect projection. Over time, commonly available "household-type" rubber bands have most often been used as ammunition in rubber band guns. In its simplest form, a rubber band gun need only be a means for retaining a stretched rubber band such that it may be aimed and selectively released. Such a rubber band gun can be achieved by simply hooking the ends of a stretched rubber band over the ends of a stick, pointing one end of the stick in the direction of desired rubber band projection, and manually unhooking and releasing the rubber band from the other end of the stick, so as to affect projection. Because of the short range of a projected rubber band, and the limited amount of kinetic energy which can be delivered to a target, the majority of rubber band guns have been designed as toys rather than as actual weapons. Over time, there have been many innovative designs put forth for rubber band guns. Many of the innovations seen in rubber band guns are analogous to innovations that have taken place in the development of actual firearm weapons. Such innovations have included multi-shot rubber band guns, semi-automatically repeating rubber band guns, a differentiation between "pistol" rubber band guns for short range shooting, and "rifle" rubber band guns for longer range shooting, and rapid-firing rubber band guns which in many ways mimic the functioning of machine guns.

With regard to rapid-firing, machine gun-like rubber band guns, examples of prior technology which are generally indicative of the state of the art can be seen in U.S. Pat. No. 2,697,425 issued Dec. 21, 1954 to McElveen, U.S. Pat. No. 4,676,219 issued Jun. 30, 1987 to Miller, U.S. Pat. No. 5,170,770 issued Dec. 15, 1992 to Vosloh, and U.S. Pat. No. 5,460,150 issued Oct. 24, 1995 to Joppe. Each of these patents pertain to rubber band gun designs which are able to produce a rapid, sequential discharge of multiple rubber bands by some means other than a semi-automatic mechanism (a mechanism which requires repeated pulling/releasing of a trigger means to produce rapidly repeating rubber band discharge.)

The chief deficiency seen in the prior technology is that rubber band guns of these designs perform in a repeating manner only so long as the operator continues to perform mechanical work upon the mechanism. The design by McElveen requires that mechanical work be continuously performed upon a combination grip/arrester means so as to affect a continuous, sequential discharge of rubber bands. The Vosloh design requires that mechanical work be continuously performed upon a trigger means so as to affect a continuous, sequential discharge of rubber bands, and the designs by Joppe and Miller both require that mechanical work be continuously performed upon a crank means so as to affect a continuous, sequential discharge of rubber bands.

The reason that the requirement of the operator to perform mechanical work while firing constitutes a deficiency is that such activity is likely to interfere with the operator's ability to accurately aim the rubber band gun, and to maintain aim throughout the sequence of rubber bands being discharged. Variations on prior technology designs may involve adding a motor to the mechanism so as to remove the need for the operator to perform work during the firing sequence. While such design variations might have a positive effect on the design in terms of the ability of the operator to accurately aim the rubber band gun, the addition of a motor would also increase the mechanical complexity and weight of the gun, which would negatively affect reliability and person-portability.

BRIEF SUMMARY OF THE INVENTION

The primary object of the invention is to provide for an automatically-repeating, rapid-firing rubber band gun, the repeated firing of which is driven solely by mechanical potential energy derived from the stretched rubber band projectiles.

Another object of the invention is to provide for an automatically-repeating, rapid-firing rubber band gun, the repeated firing of which does not require a continuous input of mechanical energy, as through a crank or motor-driven shaft, linear actuation mechanism, or by repeated manual engaging/disengaging of a trigger system.

Another object of the invention is to provide for an automatically-repeating, rapid-firing rubber band gun, the repeated firing of which requires of the operator only that the trigger be maintained in its pulled position.

A further object of the invention is to provide for an automatically repeating, rapid-firing rubber band gun of reduced mechanical complexity and enhanced reliability.

Yet another object of the invention is to provide for an automatically-repeating, rapid-firing rubber band gun which is easily person-portable and which is suitable for hand-held operation.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an automatically-repeating, rapid-firing rubber band gun with an ammunition-powered operating system comprising: a barrel assembly for both retaining and releasing a plurality of stretched rubber bands, with the release of the rubber bands occurring in such a manner as to firstly affect the transformation of a portion of the elastic potential energy present in the rubber bands into mechanical work performed upon the mechanism, and secondly affect the directionally-controlled projection of the rubber bands; a deflection assembly, relative to which, the barrel assembly moves in such a manner as to affect temporal sequencing of the release of the rubber bands from the barrel assembly, the mechanical movement occurring as a result of the transformation of a portion of the elastic potential energy present in the rubber bands into mechanical work performed on the barrel assembly; a manually-engageable trigger assembly for alternately allowing or inhibiting the release of the rubber bands from the barrel assembly; and a frame assembly for operatively supporting the barrel assembly, the deflection assembly, and the trigger assembly such that gun may be hand-held and manually operated.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
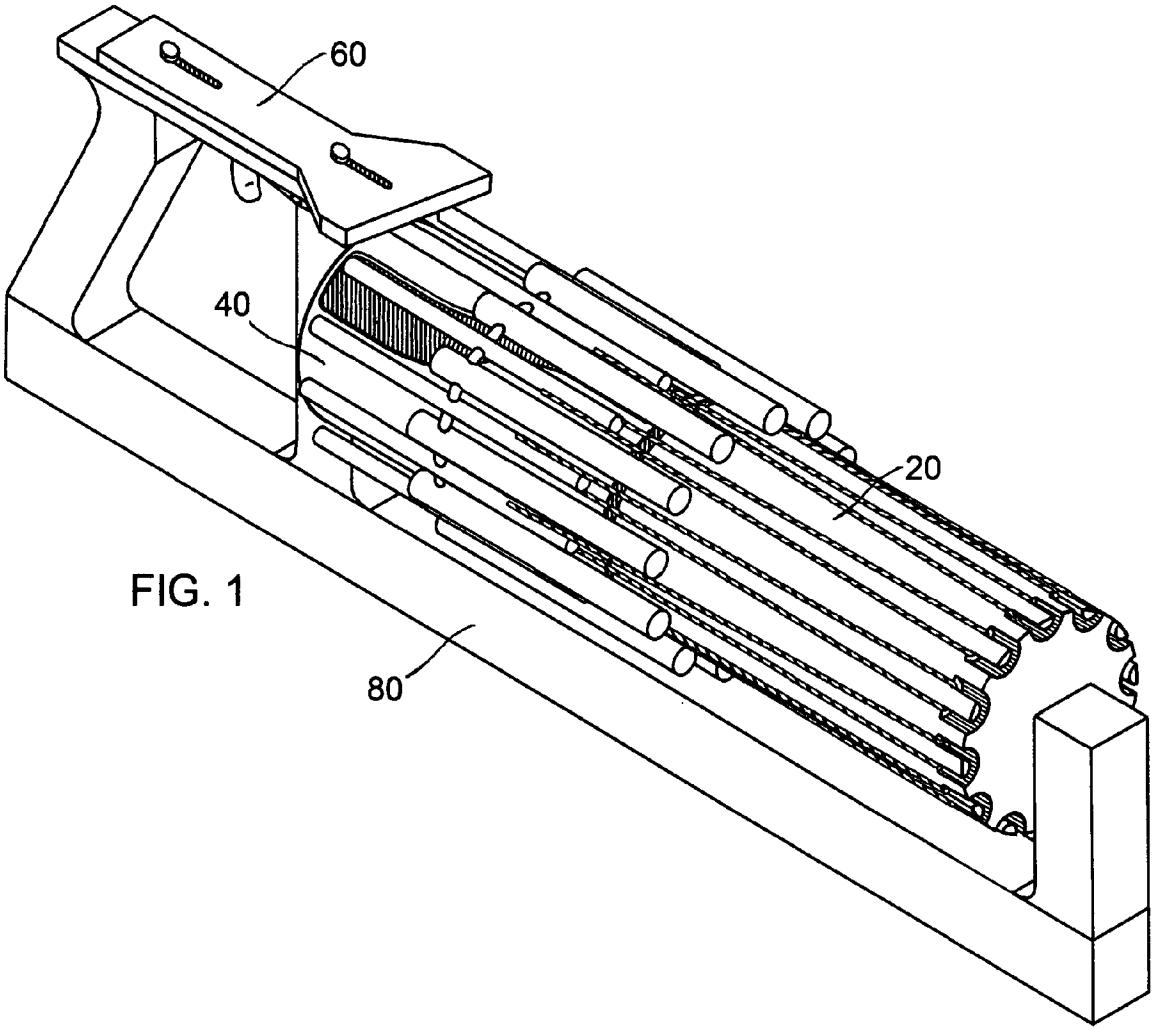
FIG. 1 is a perspective view of the gun.
Figure 2:
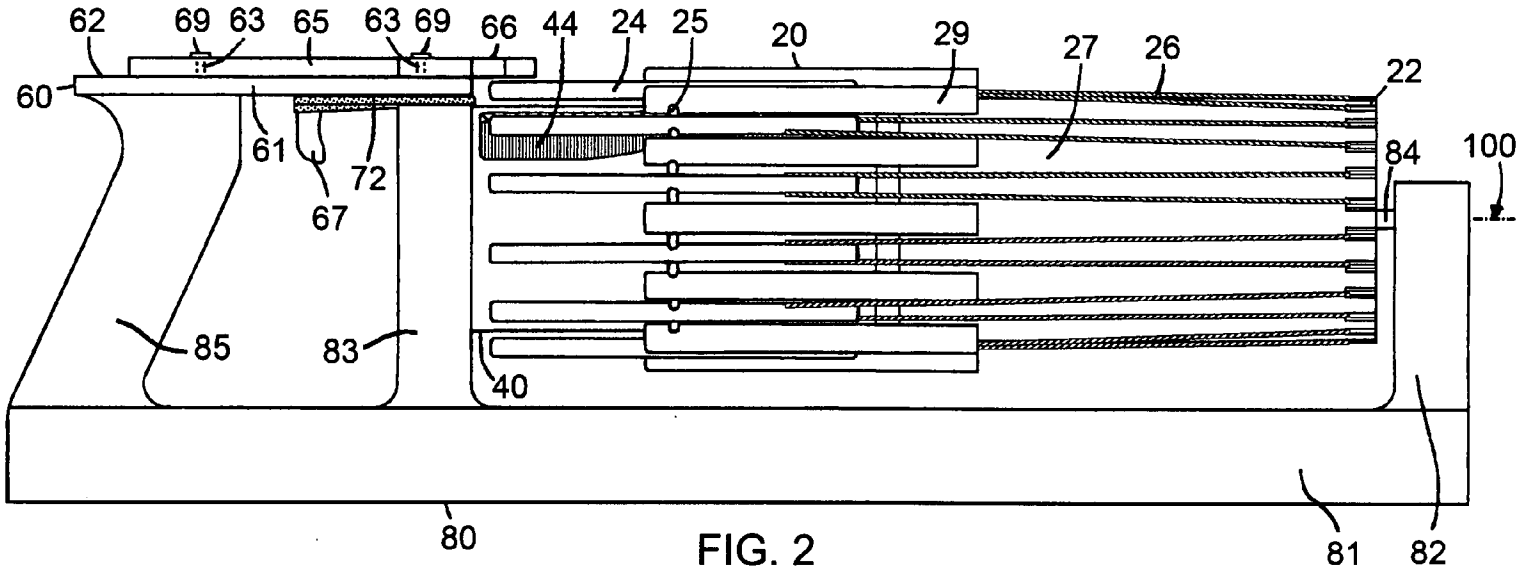
FIG. 2 is an elevational view of the right side of the gun.
Figure 3:
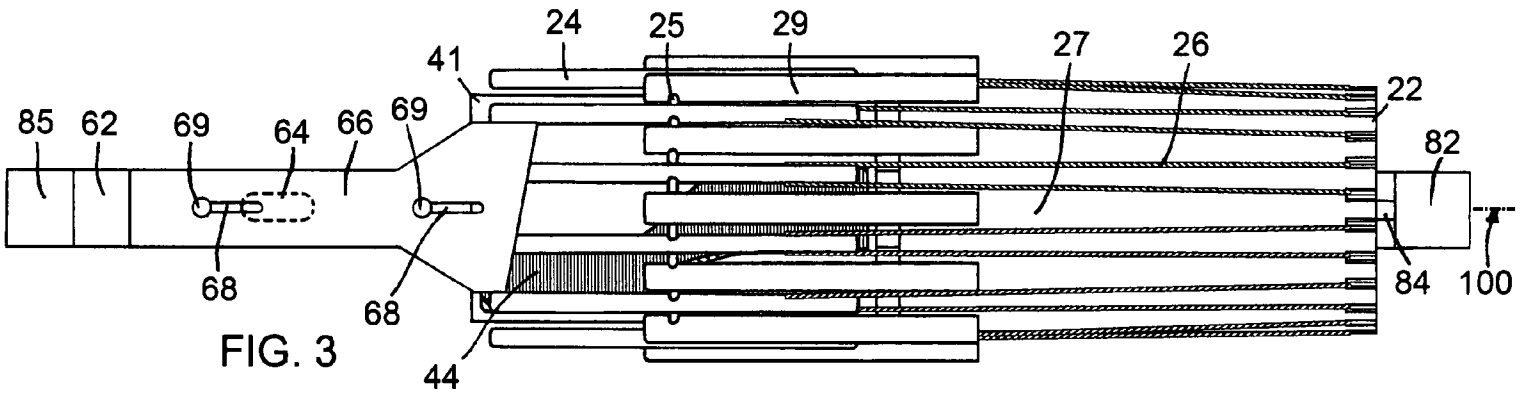
FIG. 3 is a top view of the gun.
Figure 5:
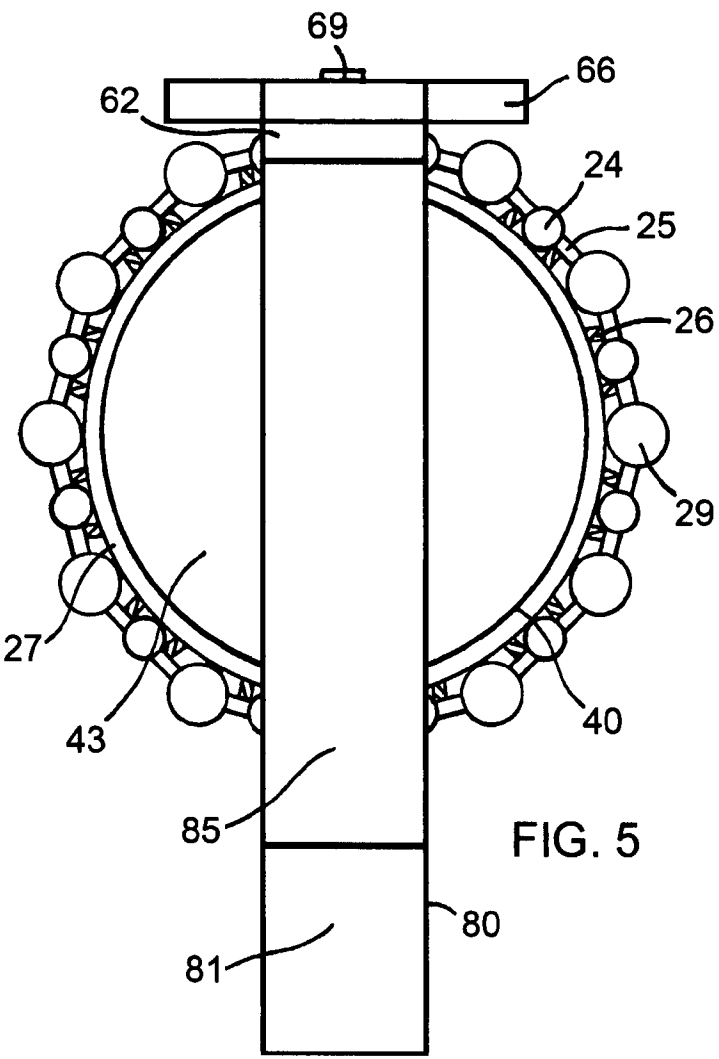
FIG. 5 is an elevational view of the back of the gun.
Figure 4:
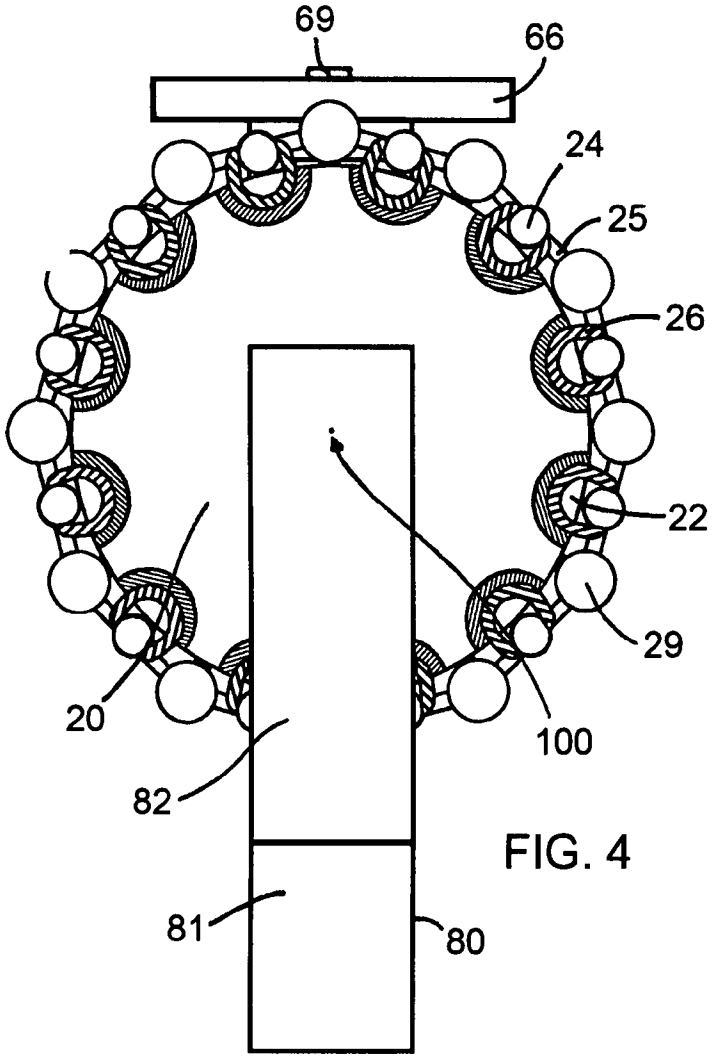
FIG. 4 is an elevational view of the front of the gun.

The present rubber band gun design consists of four major assemblies (FIG. 1): a barrel assembly 20, a deflection assembly 40, a trigger assembly 60, and a frame assembly 80.

Figure 6:
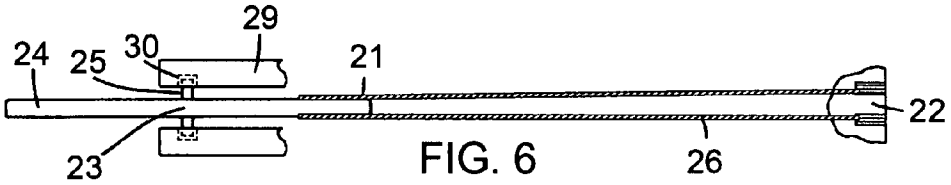
FIG. 6 is a view of a single barrel sub-assembly and the corresponding support armatures, shown apart from the remainder of the barrel assembly for clarity.
Figure 7:
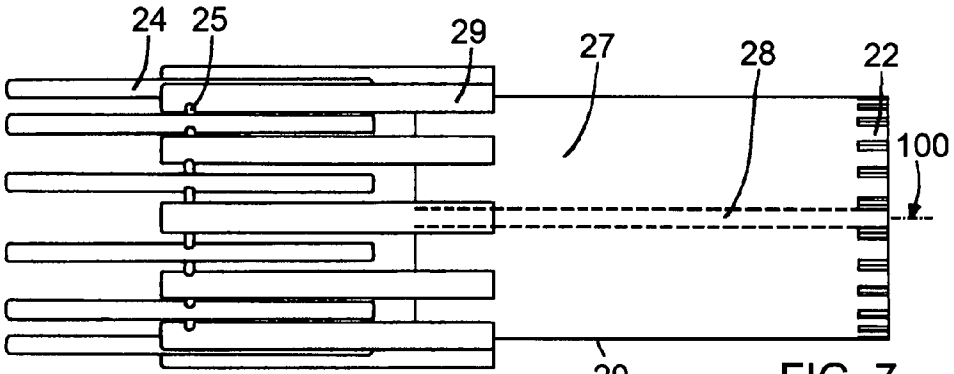
FIG. 7 is a side view of the barrel assembly, shown apart from the remainder of the gun and with the stabilizing tethers omitted for clarity.

The barrel assembly 20 (FIGS. 1, 2, 3, 4, 5, 7, 9 and 10) includes multiple identical barrel sub-assemblies 21 (FIG. 6), arranged in a radially-symmetrical configuration about a central axis. The barrel sub-assemblies 21 are attached to a core body 27 which is positioned in the forward half of the core region of the barrel assembly 20. A cylindrical hollow channel 28 runs the length the core body 27, along the central axis of the barrel assembly 20.

The central axis of the barrel assembly 20 is coincident with the central axes of several other radially-symmetrical or semi-radially-symmetrical parts of the gun. For the purpose of facilitating this description, these coincident central axes will each be introduced individually, but thereafter will be collectively referred to as the shared central axis 100.

Each of the barrel sub-assemblies 21 constitutes a single barrel of the barrel assembly 20, and each consists of a projection tab 22 at the front end of the barrel assembly 20, a double-ended lever-arm sub-assembly 23 at the rear end of the barrel assembly 20, and a stretched elastic stabilizing tether 26, linking the projection tab 22 with one end of the double-ended lever-arm 24 assembly.

For the purpose of facilitating this description, the number of barrel sub-assemblies 21 shall be twelve, however the present design may be adjusted so as to accommodate more or fewer than twelve barrel sub-assemblies 21.

The projection tabs 22 are small structures which are statically affixed to and extend from the core body 27 toward the front of the barrel assembly 20. Each projection tab 22 is of such a shape that one end of a rubber band can be hooked over the tab and retained while the other end of the rubber band is stretched, drawn toward the rear of the barrel assembly 20. With the release of the end of the rubber band drawn toward the rear, the projection tab 22 allows the rubber band to be projected toward the front of the gun and away from the barrel assembly 20.

Each double-ended lever-arm sub-assembly 23 consists of a double-ended lever-arm 24 and a transverse axle-rod 25 passing through and statically affixed to the lever-arm's 24 mid-point, with an equal length of transverse axle-rod 25 extending from opposite sides of each lever-arm 24.

The ends of the transverse axle-rod 25 of each lever-arm sub-assembly 23 are seated in sockets 30 located in support armatures 29, these support armatures 29 statically affixed to the rear end of the core body 27 of the barrel assembly 20, and extending from the core body 27 toward the rear of the barrel assembly 20.

The diameter of the sockets 30 in the support armatures 29 is slightly greater than the diameter of the transverse axle-rods 25, so as to facilitate pivoting of the transverse axle-rods 25 within the sockets 30.

The support armatures 29 function to maintain the positions of the transverse axle-rods 25 relative to the remainder of the barrel assembly 20, and allow a void space to exist within the rear portion of the core region of the barrel assembly 20, adjacent to the location of the lever-arm sub-assemblies 23.

Each stabilizing tether 26 functions to maintain a lever-arm 24 in a position with its central axis parallel to the shared central axis 100, allowing that the gun is in an unloaded condition. Tension in each of the stabilizing tethers 26 ensures that the end of the lever-arm 24 to which a tether is attached remains oriented toward the front of the barrel assembly 20. This design feature helps to prevent undesired movement of unloaded lever-arms 24, which could result in damage to the mechanism during operation of the gun.

The length of each end of each lever-arm 24 is greater than the radius of the barrel assembly 20, but less than its diameter, such that were a lever-arm 24 to be positioned in its pivot so that its longitudinal axis is perpendicular to the shared central axis 100, the end of the lever-arm 24 oriented toward the shared central axis 100 would cross the shared central axis 100 but would not extend so far as to come into contact with a support armature 29 or a parallel-positioned lever-arm 24 on the opposite side of the barrel assembly 20.

Figure 8:
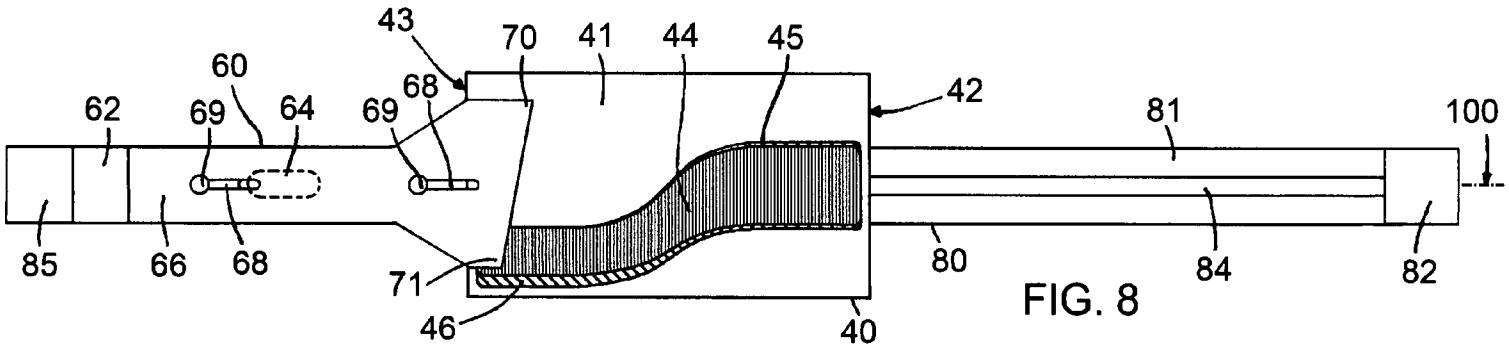
FIG. 8 is a top view of the gun with the barrel assembly omitted in order to provide a clear view of other parts.

The deflection assembly 40 (FIG. 8) is a semi-radially-symmetrical structure positioned relative to the barrel assembly 20 within the void space at the rear of the core region of the barrel assembly 20. The deflection assembly 40 is oriented such that its central axis is coincident with the shared central axis 100. The deflection assembly 40 consists of a deflection tube 41, a forward end-cap 42, and a rear end-cap 43.

The deflection tube 41 is a hollow, cylindrical tube with an external diameter slightly less than the diameter of the void space at the rear of the core region of the barrel assembly 20. A portion of the wall of the deflection tube 41 is cut away so as to form the deflection channel 44.

Figure 9:
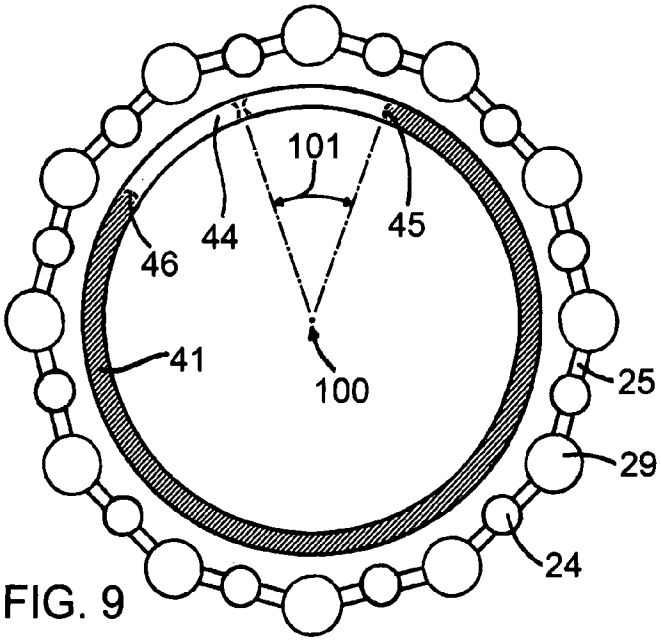
FIG. 9 is a front view of the deflection tube and select parts of the barrel assembly, depicted in such a way as to facilitate a graphic illustration of the angular advancement distance.

When viewed from above, the deflection channel 44 is seen to be a shape similar to an s-curve. The size and orientation of the deflection channel 44 is such that its forward end terminates near the forward end of the deflection tube 41, and its rear end terminates near the rear end of the deflection tube 41. The total length of the deflection channel 44 from front to rear is greater than then total length of one of the double-ended lever-arms 24. The deflection channel 44 is positioned in the wall of the deflection tube 41 such that its forward end is centered along the center-line of the gun, in the upper-most side of the deflection tube 41, while its rear end is offset to the right of the gun's center-line, in the upper, right side of the deflection tube 41. The length-wise edges of the defection channel are designated the discharge deflection edge 45 and the cocking deflection edge 46, with the left-most edge being the discharge deflection edge 45 and the right-most edge being the cocking deflection edge 46. The length-wise edges form smooth, continuous curves from their forward to rear ends. At the forward and rear ends of the deflection channel 44, the length-wise edges are parallel to the shared central axis 100, while at the middle point in the channel's length, the orientation of the edges deviates by a maximum of forty-five degrees from what would be a parallel orientation to the shared central axis 100. As illustrated in FIG. 9, the width of the deflection channel 44 at its forward end corresponds to the angular advancement distance 101, which is an angular distance about the shared central axis 100 which is greater than the angular distance between the central axes of any two adjacent lever-arms 24 only by an amount sufficient to allow for the forward ends of any two adjacent lever-arms 24 to be simultaneously positioned entirely over the forward end of the deflection channel 44. The rear end of the deflection channel is of the same width as the forward end.

The angular displacement of one end of the deflection channel 44 from the other end also corresponds to the angular advancement distance 101.

The forward end-cap 42 is statically affixed to and encloses the forward end of the deflection tube 41.

The rear end-cap 43 is statically affixed to and encloses the rear end of the deflection tube 41.

The frame assembly 80 (FIGS. 1, 2, 3, 4, 5, and 8) includes a frame base 81, a barrel support post 82, a deflection support post 83, a longitudinal axle-rod 84, and a grip 85.

The frame base 81 is a structure which extends longitudinally from the front of the gun to the rear of the gun, and which is positioned toward the underside of the gun relative to the other parts of the gun.

The barrel support post 82 is a structure which extends vertically from and is statically affixed to the frame base 81 near the front end of the frame base 81. The upper-most extent of the barrel support post 82 lies slightly above the shared central axis 100.

The deflection support post 83 is a structure which extends vertically from and is statically affixed to the frame base 81 in the area of the frame base 81 disposed beneath and to the immediate rear of the deflection assembly 40. The upper most extent of the deflection support post 83 is approximately even with the upper most extent of the barrel assembly 20, and the rear surface of the rear end-cap 43 of the deflection assembly 40 is statically affixed to the forward surface of the deflection support post 83.

The longitudinal axle-rod 84 occupies the aforementioned hollow channel 28 in the core body 27 of the barrel assembly 20. The central axis of the longitudinal axle-rod 84 is coincident with the shared central axis 100, and the diameter of the longitudinal axle-rod 84 is slightly less than the diameter of the hollow channel 28 in the core body 27 of the barrel assembly 20, so as to facilitate pivoting of the barrel assembly 20 about the longitudinal axle-rod 84. The longitudinal axle-rod 84 is statically affixed to other parts of the gun at both of the longitudinal axle-rod's 84 ends, with one end terminating slightly forward of the forward-most extent of the barrel assembly 20, and the other end terminating slightly to the rear of the rearward most extent of the core body 27 of the barrel assembly 20. At its forward end, the longitudinal axle-rod 84 is statically affixed to the rear surface of the barrel support post 82. At its rear end, the longitudinal axle-rod 84 is statically affixed to the forward surface of the forward end-cap 42 of the deflection assembly 40.

The grip 85 is a structure which extends vertically from and is statically affixed to the frame base 81 near the rear end of the frame base 81, to the rear of the deflection support post 83. Sufficient space exists between the grip 85 and the deflection support post 83 to allow the grip 85 to be manually grasped. The upper most extent of the grip 85 is even with the upper most extent of the deflection support post 83

The trigger assembly 60 (FIGS. 1, 2, 3, 4, 5, 8 and 11) includes the trigger guide 61 and the trigger slide 65.

The trigger guide 61 consists of a guide plate 62 statically affixed across the tops of the grip 85 and the deflection support post 83, and two guide posts 63 statically-affixed to and extending vertically from the upper surface of the guide plate 62, one guide post positioned above the top of the grip 85 and the other positioned above the top of the deflection support post 83. The guide plate 62 has a trigger channel 64, which is a longitudinal channel cut through the guide plate 62 within the portion of its length traversing the space between the top of the grip 85 and the top of the deflection support post 83.

The trigger slide 65 is positioned above the guide plate 62 and consists of a slide plate 66 and a trigger post 67. The forward end of the slide plate 66 extends beyond the deflection support post 83. The lower surface of the forward end of the slide plate 66 lies slightly above the rear ends of horizontally-positioned lever-arms 24 on the upper side of the barrel assembly 20. The width of the slide plate 66 at its forward end is approximately twice the width of the forward end of the deflection channel 44, and the width of the slide plate 66 at its rear end is approximately equal to the width of the guide plate 62. The slide plate 66 has two guide channels 68 cut into it, which are longitudinal channels coincident with the locations of the guide posts 63. The guide posts 63 extend through the guide channels 68 in the slide plate 66 and are capped above the slide plate 66 with retention caps 69, these caps having a diameter greater than the width of the guide channels 68, thereby retaining the trigger slide 65 in the vertical aspect of its position relative to the trigger guide 61.

The trigger post 67 is statically-affixed to the lower surface of the slide plate 66, and extends from the lower surface of the slide plate 66, through the trigger channel 64 in the guide plate 62, and into the upper portion of the space between the deflection support post 83 and the grip 85, such that the trigger post 67 may be manually engaged with the index finger of a hand which grasps the grip 85.

The width of the guide channels 68 is slightly greater than the width of the guide posts 63, the width of the trigger channel 64 is slightly greater than the width of the trigger post 67, and the distance between the upper surface of the guide plate 62 and the lower surfaces of the retention caps 69 is slightly greater than the thickness of the slide plate 66, so as to allow the trigger slide 65 to move with relatively little friction in a forward-to-rear or rear-to-forward direction relative to the trigger guide 61. The length of the guide channels 68 limits the total movement of the trigger slide 65 relative to the trigger guide 61.

When the trigger slide 65 is in its forward-most position, or its interference position, the forward end of the slide plate 66 interferes with the potential pivotal arc-of-travel of the rear end of a lever-arm 24 whose forward end is positioned above the forward end of the deflection channel 44, thereby preventing that lever-arm 24 from being able to pivot such that its forward end passes into the forward end of the deflection channel 44.

When the trigger slide 65 is in its rear position, it does not interfere with the arc of travel of any lever-arm 24.

The forward edge of the forward end of the slide plate 66 is angled, such that the left-forward corner 70 is further forward than the right-forward corner 71. With the forward edge of the slide plate 66 so angled, when there are two lever-arms 24 positioned with their forward ends entirely over the forward end of the deflection channel 44, and the trigger slide 65 is slid rearward, the forward edge of the slide plate 66 will come out of its interference position with the rear end of the right-most of the two lever-arms 24 before it comes out of its interference position with the rear end of the left-most of the two lever-arms 24.

A trigger-return rubber band 72 is hooked around the upper portion of the trigger post 67, below the guide plate 62, and looped forward, on one side of the gun, around the upper portion of the deflection support post 83 and back on the other side of the gun to the trigger post 67. Under tension, the trigger-return rubber band 72 maintains the trigger slide 65 in its interference position by default, but allows the trigger post 67 to be manually pulled to the rear, so as to bring the trigger slide 65 out of its interference position.

With regard to construction of a rubber band gun of the present design, unless otherwise specified in the preceding text, a high-strength plastic or high-quality hard-wood may be used to form most of the parts. Parts which may be subject to particularly high levels of stress, such as the longitudinal axle-rod 84 of the frame assembly 80, or the transverse axle-rods 25 of the double-ended lever-arm sub-assemblies 23, may be fabricated from a high-strength metal alloy, such as stainless steel. Parts which are specified as being statically affixed shall be welded, glued, or mechanically fastened in a manner consistent with being able to withstand the stresses placed on them by the operation of the mechanism.

To operate a rubber band gun of the present design, a number of stretched rubber bands 90 must first be loaded onto the gun's mechanism. To accomplish this, one must first cock each lever-arm sub-assembly 23 by turning it a half turn or one-hundred-and-eighty degrees about the central axis of its transverse axle-rod 25. This is accomplished by approaching the gun from it's right side and using one's left hand to manually apply pressure to the rear end of a lever-arm 24 that is positioned above the rear end of the deflection channel 44, so as to cause the rear end of the lever-arm 24 to pivot into the rear end of the deflection channel 44 and the front end of the lever-arm 24 to pivot upward, away from the deflection channel 44. The front end of the lever-arm 24 being cocked is now manually grasped with one's right hand and the rear end is release from one's left hand. Pressure is maintained on the lever-arm 24 so as to continue to pivot it until its forward and rear ends have reversed and what is now the rear end comes into the area of the forward end of the trigger slide 65. At this point, one's left hand is used to manually push the trigger slide 65 to the rear, out of its interference position, as one's right hand continues to apply pressure to the lever-arm 24 until it completes its one-hundred-and-eighty degree pivot. The trigger slide 65 is then allowed to return to its forward, interference position, whereby the lever-arm 24 that has just been cocked is retained in its cocked position by the forward end of the trigger slide 65.

Through the course of the one-hundred-and-eighty degree cocking pivot of a lever-arm 24, the rear end of the lever-arm 24 pivots into the deflection channel 44, contacts and slides along the cocking deflection edge 45, and deflects laterally to the left, causing the entire barrel assembly 20 to rotate relative to the frame assembly 80. This rotation is in a counterclockwise direction, when viewed from the rear of the gun. Upon the completion of a one-hundred-and-eighty degree cocking pivot of a lever-arm 24, the barrel assembly 20 has rotated relative to the frame assembly 80 by a number of degrees equal to the angular advancement distance 101, and the next lever-arm 24 to be cocked has come into position above the rear end of the deflection channel 44. The procedure for cocking a lever-arm 24 is repeated until each lever-arm 24 has been cocked one time.

After each lever-arm 24 has been cocked, one stretched rubber band 90 is loaded onto each barrel sub-assembly 21 of the barrel assembly 20 by hooking one end of the rubber band 90 over the rear end of a lever-arm 24, and hooking the other end of the rubber band 90 over the corresponding projection tab 22 at the forward end of the barrel assembly 20. After one rubber band 90 has been loaded on to each barrel sub-assembly 21, all of the lever-arms 24 must be cocked again prior to loading additional rubber bands 90. The process of cocking the lever-arms 24 and loading rubber bands 90 is repeated until multiple rubber bands 90 have been loaded onto each barrel sub-assembly 21.

Figure 11:
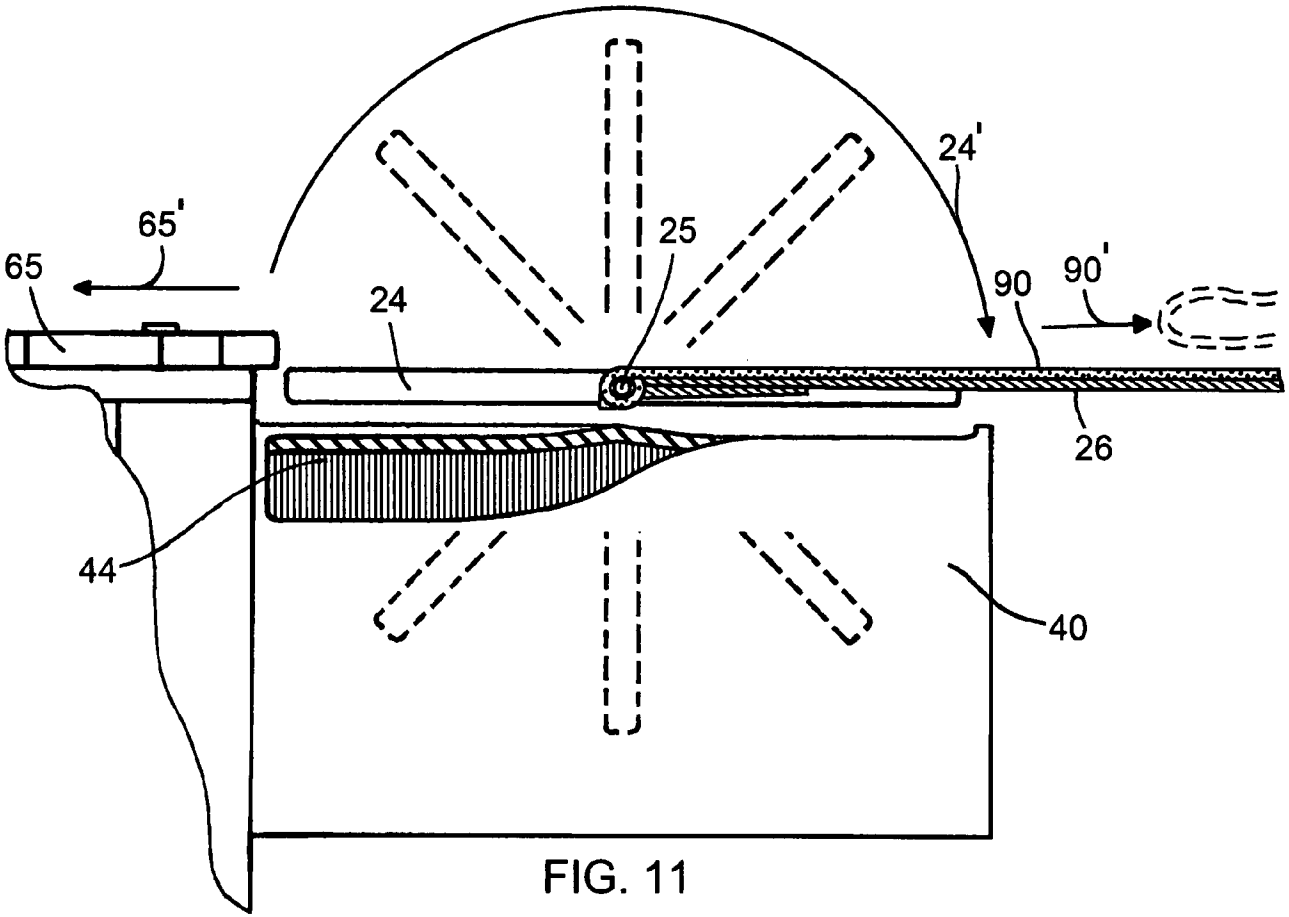
FIG. 11 is a side view of the deflection assembly, trigger assembly, and a single barrel sub-assembly, showing particular aspects of the relative movement of parts of the mechanism during the firing cycle.

As illustrated in FIG. 11, when multiple rubber bands 90 are loaded onto a barrel sub-assembly 21, the rear ends of the loaded stretched rubber bands 90, along with the rear ends of the stabilizing tethers 26, will be wound around the transverse axle-rod 25 of each lever-arm sub-assembly 23. Stretched and wound as such, the rubber bands 90 loaded onto the gun's mechanism apply torque to the lever-arm sub-assemblies 23, causing them to pivot such that the forward ends of most of the lever-arms 24 come into contact with the outer surface of the deflection tube 41. In the case of the lever-arms 24 positioned above the forward end of the deflection channel 44, when those lever-arms 24 pivot, their rear ends come into contact with the lower surface of the forward end of the slide plate 66 of the trigger slide 65, allowing that the trigger slide 65 is in its interference position. As described previously, this interference of the trigger slide 65 prevents these lever-arms 24 from pivoting so far that their forward ends pass into the forward end of the deflection channel 44.

Figure 10:
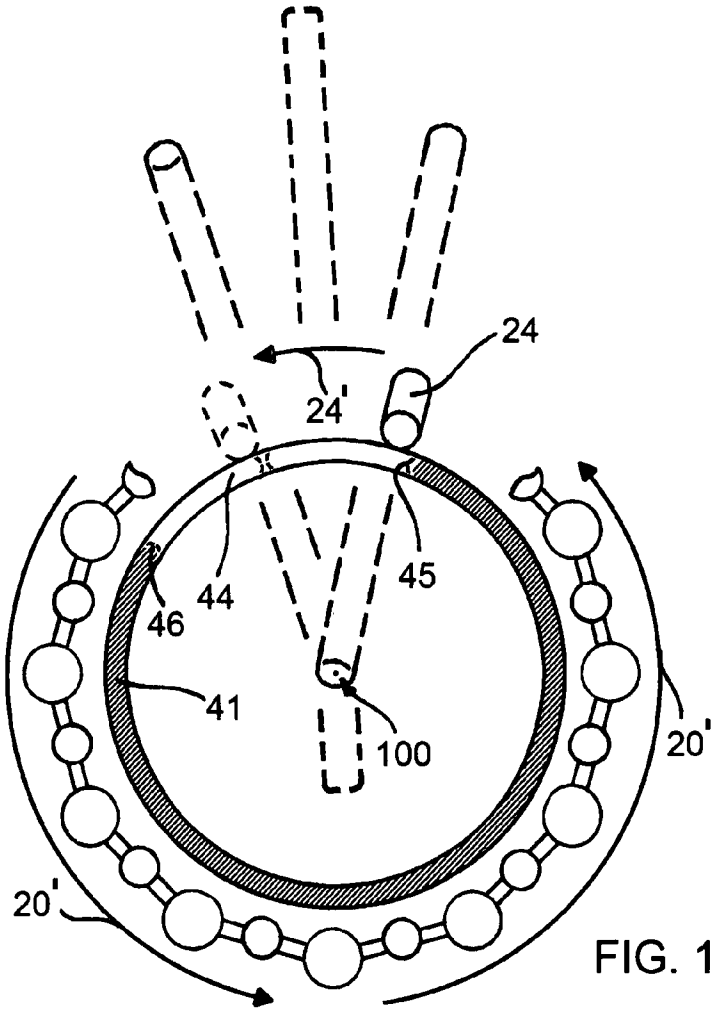
FIG. 10 is a front view of the deflection tube and select parts of the barrel assembly, depicted in such a way as to facilitate a graphic illustration of the rotational movement of a single lever-arm relative to the deflection channel, as well as the related movement of the whole of the barrel assembly relative to the remainder of the gun.

To fire the rubber band gun, the grip 85 is manually grasped and the trigger post 67 is manually pulled to the rear. When the trigger post 67 is pulled to the rear, the trigger slide 65 comes out of its interference position with the rear end of a lever-arm 24 whose forward end is positioned over the forward end of the deflection channel 44 (FIG. 11.) Owing to the torque being applied to the lever-arm 24 by the loaded rubber bands 90, the forward end of the lever-arm 24 pivots into the deflection channel 44, contacts and slides along the discharge deflection edge 45, and deflects laterally to the right, causing the entire barrel assembly 20 to rotate relative to the deflection tube 41 (FIG. 10). This rotation of the barrel assembly 20 is in a clockwise direction, when viewed from the rear of the gun. As the lever-arm 24 completes its one-hundred-and-eighty degree pivot through the deflection channel 44, its action has caused the barrel assembly 20 to rotate about the shared central axis 100 by a number of degrees equivalent to the angular advancement distance 101. Upon completion of its one-hundred-and-eighty degree pivot, a single rubber band 90, the last of those loaded onto that lever-arm 24, is release and projected, and the lever-arm 24 comes to rest with its ends reversed and its new front end in contact with the surface of the deflection tube 41 just to the right of the forward end of the cocking deflection edge 46 of the deflection channel 44.

As the first lever-arm 24 completes its passage through the deflection channel 44, the next lever-arm 24 in line, which is the lever-arm 24 adjacent and to the left of the first, comes into position over the forward end of the deflection channel 44. Allowing that the trigger slide 65 is maintained in its rearward position, the next lever-arm 24 begins to pivot into the channel in the same manner as did the first. This cycle continues to repeat, with successive lever-arms 24 pivoting through the deflection channel 44 and releasing rubber bands 90, until either all rubber bands loaded onto the mechanism have been discharged or until the trigger slide 65 is allowed to return to its interference position.

What is claimed is:

1. An automatically-repeating, rapid-firing rubber band gun with an ammunition-powered operating system comprising:

a barrel assembly for both retaining and releasing a plurality of stretched rubber bands, with said release of said rubber bands occurring in such a manner as to chronologically first affect the transformation of a portion of the elastic potential energy present in said rubber bands into mechanical work performed upon said barrel assembly, and chronologically second affect the directionally-controlled projection of said rubber bands;

a deflection assembly, relative to which said barrel assembly moves in such a manner as to affect temporal sequencing of said release of said rubber bands from said barrel assembly, said mechanical movement occurring as a result of said transformation of said portion of said potential energy present in said rubber bands into said mechanical work performed upon said barrel assembly;

a manually-engageable trigger assembly for alternately allowing or inhibiting said release of said rubber bands from said barrel assembly; and a frame assembly for operatively supporting said barrel assembly, said deflection assembly, and said trigger assembly such that said gun may be hand-held and manually operated.

2. An automatically-repeating, rapid-firing rubber band gun with an ammunition-powered operating system as claimed in claim 1 wherein said barrel assembly has a radially-symmetrical configuration, with a front and a rear end arranged along a central axis, and is comprised of:

a core body located in the front portion of the core area of said barrel assembly;

a plurality of support armatures statically affixed to and extending from said core body toward the rear of said barrel assembly; and a plurality of identical barrel sub-assemblies, said barrel sub-assemblies being arranged around the perimeter of said core area, with the longitudinal axes of said barrel sub-assemblies being parallel to the central axis of said barrel assembly.

3. An automatically-repeating, rapid-firing rubber band gun with an ammunition-powered operating system as claimed in claim 2 wherein said barrel sub-assemblies are each comprised of:

a projection tab statically affixed to the front end of said barrel assembly;

a double-ended lever-arm sub-assembly at the rear of said barrel assembly;

and a stretched elastic stabilizing tether extended parallel to the longitudinal axis of said barrel sub-assembly, and linking, under tension, said projection tab with one end of said double-ended lever-arm sub-assembly.

4. An automatically-repeating, rapid-firing rubber band gun with an ammunition-powered operating system as claimed in claim 3 wherein said double-ended lever-arm sub-assemblies are each comprised of:

a double-ended lever-arm;

and a transverse axle-rod, perpendicular to said double-ended lever-arm, passing through and statically affixed to said double-ended lever-arm at the midpoint of said double-ended lever-arm, with equal portions of said axle-rod extending from opposite sides of said double-ended lever-arm, and with the ends of said axle-rod seated loosely in sockets in support armatures.

5. An automatically-repeating, rapid-firing rubber band gun with an ammunition-powered operating system as claimed in claim 4 wherein said core body functions to maintain said radially-symmetrical configuration of said barrel assembly, and is formed around a continuous longitudinal channel lying along the central axis of said barrel assembly.

6. An automatically-repeating, rapid-firing rubber band gun with an ammunition-powered operating system as claimed in claim 5 wherein said support armatures are formed with sockets near the rear ends of said support armatures to receive and support said ends of said transverse axle-rods of said double-ended lever-arm sub-assemblies, and wherein said support armatures are oriented so as to allow for the existence of a void space within the rear portion of said core area of said barrel assembly.

7. An automatically-repeating, rapid-firing rubber band gun with an ammunition-powered operating system as claimed in claim 6 wherein said deflection assembly is a semi-radially-symmetrical assembly, with a central axis coincident with the central axis of said barrel assembly, which extends into said void space within the rear portion of said core area of said barrel assembly, and which is comprised of:

a cylindrical deflection tube;

a front end-cap; and a rear end-cap.

8. An automatically-repeating, rapid-firing rubber band gun with an ammunition-powered operating system as claimed in claim 7 wherein said deflection tube is a hollow tube with a portion of the wall of said hollow tube cut away so as to form a deflection channel.

9. An automatically-repeating, rapid-firing rubber band gun with an ammunition-powered operating system as claimed in claim 8 wherein said mechanical work performed upon said barrel assembly causes said lever-arms to interact with said deflection channel in such a manner as to produce movement of said barrel assembly relative to said deflection assembly.

10. An automatically-repeating, rapid-firing rubber band gun with an ammunition-powered operating system as claimed in claim 9 wherein said rear end-cap of said deflection assembly is statically affixed to said frame assembly.

11. An automatically-repeating, rapid-firing rubber band gun with an ammunition-powered operating system as claimed in claim 10 wherein said frame assembly is comprised of:

a frame base;

a barrel support post;

a deflection support post;

a longitudinal axle-rod; and a grip.

12. An automatically-repeating, rapid-firing rubber band gun with an ammunition-powered operating system as claimed in claim 11 wherein said frame base is a structure which extends longitudinally from the front of said gun to the rear of said gun, and which is positioned toward the underside of said gun relative to other parts of said gun.

13. An automatically-repeating, rapid-firing rubber band gun with an ammunition-powered operating system as claimed in claim 12 wherein said barrel support post is a structure which extends vertically from and is statically affixed to said frame base near the front end of said frame base, with its upper-most extent being slightly above the central axis of said barrel assembly.

14. An automatically-repeating, rapid-firing rubber band gun with an ammunition-powered operating system as claimed in claim 13 wherein said deflection support post is a structure which extends vertically from and is statically affixed to said frame base in the area of said frame base disposed beneath and to the immediate rear of said deflection assembly, with it's upper-most extent being approximately even with the upper most extent of said barrel assembly, and to which said rear end-cap of said deflection assembly is statically affixed.

15. An automatically-repeating, rapid-firing rubber band gun with an ammunition-powered operating system as claimed in claim 14 wherein said longitudinal axle-rod has a central axis coincident with the central axis of said barrel assembly, extends through said longitudinal channel in said core body of said barrel assembly, is of a diameter slightly less than the diameter of said longitudinal channel, is statically affixed at it's front end to said barrel support post, and is statically affixed at it's rear end to said front end-cap of said deflection assembly.

16. An automatically-repeating, rapid-firing rubber band gun with an ammunition-powered operating system as claimed in claim 15 wherein said grip is a structure which extends vertically from and is statically affixed to said frame base near the rear end of said frame base, to the rear of and spatially separated from said deflection support post, and with it's upper most extent being even with the upper most extent of said deflection support post.

17. An automatically-repeating, rapid-firing rubber band gun with an ammunition-powered operating system as claimed in claim 16 wherein said trigger assembly is comprised of:

a trigger guide; and a trigger slide.

18. An automatically-repeating, rapid-firing rubber band gun with an ammunition-powered operating system as claimed in claim 17 wherein said trigger guide is statically affixed to the upper-most extent of said grip and the upper-most extent of said deflection support post, and functions to guide movement of said trigger slide.

19. An automatically-repeating, rapid-firing rubber band gun with an ammunition-powered operating system as claimed in claim 18 wherein said trigger slide can be manually engaged so as to affect temporary movement and displacement relative to said trigger guide, and wherein the default, unengaged state of said trigger slide is such as to inhibit the release of said rubber bands from said barrel assembly, while the alternate, manually-engaged state of said trigger slide is such as to allow the release of said rubber bands from said barrel assembly.

20. An automatically-repeating, rapid-firing rubber band gun with an ammunition-powered operating system as claimed in claim 19 wherein, when said trigger slide is manually engaged, said gun functions so as to continuously and sequentially release said rubber bands from said barrel assembly, until either all of said rubber bands have been released from said barrel assembly or said trigger slide ceases to be manually engaged.

* * * * *